United States Patent [19]

Winzeler et al.

[11] 3,955,338

[45] May 11, 1976

[54] APPARATUS FOR FORMING GUSSET PLEATS IN TUBULAR BAGS

[75] Inventors: Bruno Winzeler, Lohningen; Roland Watzka, Langwiesen, both of Switzerland

[73] Assignee: SIG Schweizerische Industrie-Gesellschaft, Neuhausen am Rheinfall, Switzerland

[22] Filed: Jan. 22, 1975

[21] Appl. No.: 542,891

[30] Foreign Application Priority Data

Jan. 24, 1974 Switzerland ..... 993/74

[52] U.S. Cl. ..... 53/180 R; 53/371

[51] Int. Cl.[2] ..... B65B 51/20

[58] Field of Search ..... 53/180, 182, 371, 373

[56] References Cited

FOREIGN PATENTS OR APPLICATIONS

| | | | |
|---|---|---|---|
| 1,511,594 | 8/1969 | Germany | 53/180 |
| 665,667 | 9/1938 | Germany | 53/182 |

*Primary Examiner*—Leon Gilden

*Attorney, Agent, or Firm*—Spencer & Kaye

[57] ABSTRACT

In a continuously operating packaging machine for packaging items at uniform intervals in a tube of sealable packaging material, the narrow sides of the tube are folded inwardly in the region between successive items, where a transverse seam is subsequently formed, by blowing a jet of gaseous medium against the center line of each narrow side, from two nozzles, in each such region.

10 Claims, 5 Drawing Figures

ROTATIONAL SLIDE
HEATING
SOURCE

APPARATUS FOR FORMING GUSSET PLEATS IN TUBULAR BAGS

BACKGROUND OF THE INVENTION

The present invention relates to an apparatus for forming gusset pleats in tubular packaging bags in a continuously operating packaging machine.

In such a machine, two oppositely disposed narrow sides of a tube of sealable material containing the items to be packaged at uniform mutual spacings are folded inwardly before a transverse seam is formed in the tube between every two items. An apparatus of this type is disclosed, for example, in commonly assigned U.S. application Ser. No. 422,143, filed by Christoph Mangold on Dec. 6th, 1973, now abandoned.

In this and in other known apparatuses mechanical pleating members are provided for forming the gusset pleats. It has been found in practice that these mechanical folding members cannot produce more than about 400 packages per minute.

SUMMARY OF THE INVENTION

It is a primary object of the present invention to increase this output limit to about 600 packages per minute.

This and other objects of the present invention are achieved by the provision of two nozzles which direct two jets of a gaseous medium to the oppositely disposed narrow side of the tube so as to cause these sides to be folded inwardly.

Compared to the prior art devices employing mechanical folding members, such an apparatus has the advantage that it can produce a much higher output. For example, the number of packages produced per minute can be increased by about 50%. In addition to the increase in output, there also results in practice a substantial simplification of the structure of the device.

It has been found, however, that in some cases perfect folds in the narrow sides of the tube are not assured with the use of the above-mentioned apparatus, for example when the height of these narrow sides is small, i.e. when the packages are thin; and also when the tube is of a relatively stiff foil, e.g. an aluminum foil.

According to a further embodiment of the present invention, satisfactory folding even for relatively thin packages and stiff foils is assured by arranging the two nozzles to be movable and by pressing them during every operating cycle against the narrow sides of the packaging tube so that they mechanically produce in the tube an indentation which initiates the fold to be made by the respective jet of gaseous medium.

DESCRIPTION OF THE PREFERRED EMBODIMENTS

Figures 1, 2, 3:
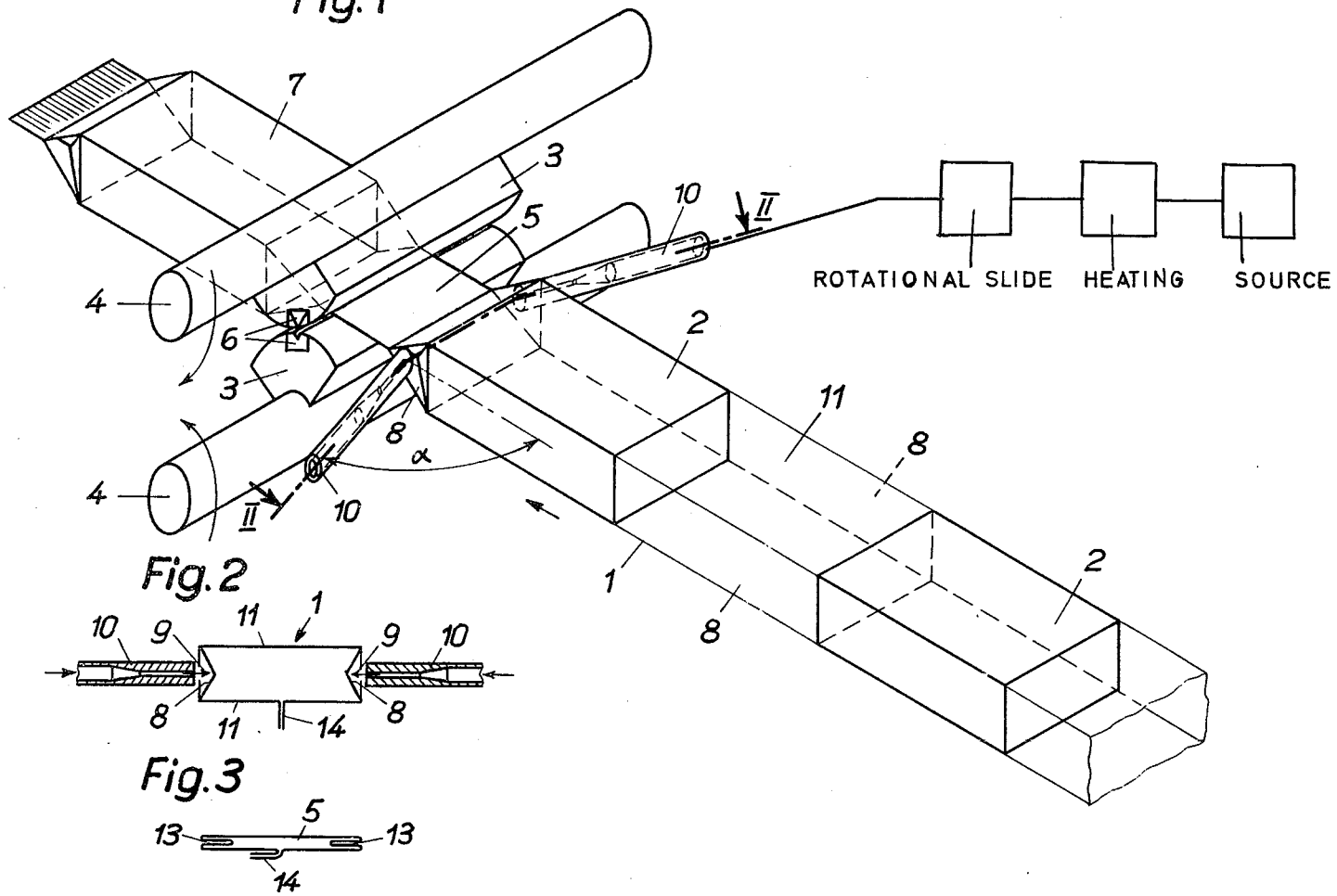
FIG. 1 is a perspective view of an apparatus for forming gusset pleats according to the present invention.
FIG. 2 is a cross-sectional view taken along line II — II of FIG. 1.
FIG. 3 is a cross-sectional view through the transverse seam produced by means of the sealing jaws in the apparatus of FIGS. 1 and 2.

The apparatus shown in FIGS. 1 through 4 is provided in a continuously operating packaging machine of known type. The apparatus receives a packaging tube 1 which already contains items 2 spaced at uniform intervals and which are now to be completely individually packaged. The tube is shown as being of a transparent material. The tube could, for example, be of a cellulose film having a weight of 30g/m², and coated with polyvinylidene chloride to have a total weight of 35g/m².

Two sealing jaws 3, which are fastened to two respective shafts 4 rotating counter to one another, serve to form transverse seams 5 in the intervals between the successive items 2. Tube 1 may be made, for example, of plastic-coated paper or some other sealable material, i.e. a material of which two superposed parts can be bonded, and more specifically welded, together by means of pressure, or heat and pressure. The sealing jaws 3 are provided with a pair of mating blades 6 which cut the forming transverse seam 5 along its center so that, after passage of the tube 1 between shafts 4 and jaws 3, the finished tubular bags 7 are separated from one another. However, it would also be possible to provide a cutting device separate from the sealing jaws 3 which in a known manner would cut through a transverse seam only after a group of two or more packages has been formed.

In order to limit the length of the transverse seams 5 to the width of the items 1, it is known to be necessary to fold the narrow sides 8 of the tube 1 inwardly in the spaces between the items 2 before the tube 1 is gripped by the sealing jaws 3. This folding is effected in the present apparatus by two jets of air 9, shown in detail in FIG. 2, which are directed toward the narrow sides 8 from two nozzles 10.

The air passing through the nozzles may have a pressure of, for example 4 to 6 atmospheres gauge and the exit diameter of the nozzles may be 1 to 2.5 mm; the most favorable values depend on the size of the packages, the material of the tube, etc. Nozzles 10 are advisably disposed in the center plane of tube 1 which passes through the middle of the narrow sides 8 and are advisably inclined at an angle $\alpha$ of 75° to 90°, preferably about 80°, with respect to the longitudinal direction of the tube.

Figure 4:
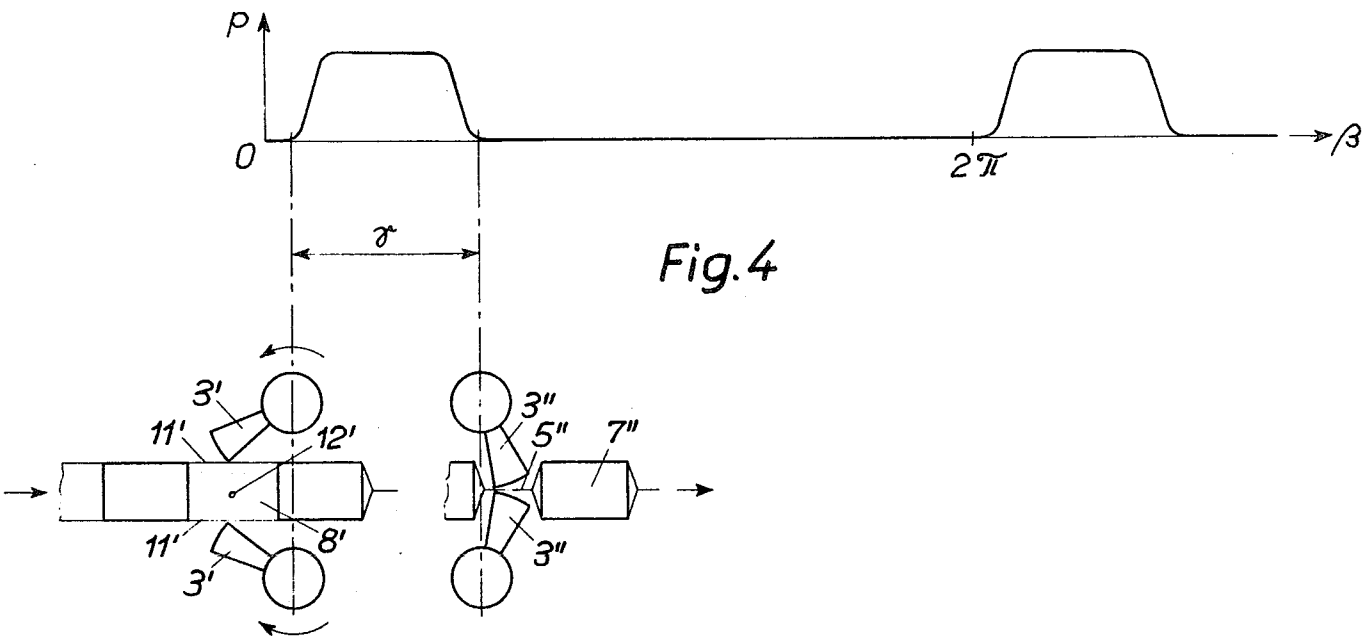
FIG. 4 is a diagram showing the time sequence of the pressurized air input during operation of the apparatus of FIG. 1.

For reasons of economy, the pressurized air is preferably not permitted to flow continuously towards the narrow sides 8, but only during the periods of time when the sealing jaws 3 are effective. In the diagram of FIG. 4 the angle of rotation $\beta$ of the sealing jaws is plotted on the abscissa beginning with an arbitrary 0 point, while the ordinate relates to the pressure p of the air present at the entrance of nozzles 10. A rotational slide, or valve, of known type is provided in the input line for the pressurized air. This valve includes a rotating disc or cylinder provided with a slit extending in the peripheral direction over a center angle $\gamma$. This slit acts to unblock a passage for the pressurized air once during each revolution, and the passage is otherwise covered by the disc.

The rotational slide is coupled with shafts 4 so that it opens at the moment when sealing jaws 3 come in contact with the broad sides 11 of the tube 1, as shown in FIG. 4 at 3′ and 11′. The slide closes again when the jaws 3 leave the formed seam 5 as shown at 3″ and 5″.

The increase and decrease in pressure of course do not occur suddenly, mainly because the slit of the rotating disc effects a more or less gradual, or progressive, opening and closing of the passage. The point at which the respective jet of air 9 impinges is shown on one narrow side 8' at 12' in FIG. 4.

FIG. 2 shows how the jets of air 9 fold the narrow sides 8 inwardly and FIG. 3 shows how the foil material of the tube is folded to overlap at seam 5. The contacting foil portions are shown with some separation only for reasons of clarity while the original inner surfaces of the tube 1 of course actually adhere closely to one another. The opposing surfaces of the gusset pleats 13 produced by folding of the narrow sides 8 do not adhere to one another, however. The longitudinal seam 14 of tube 1 formed by two adhering longitudinal strips is folded over in a known manner onto the respective main wall 11 shortly before the tube enters between the jaws 3.

Figure 5:
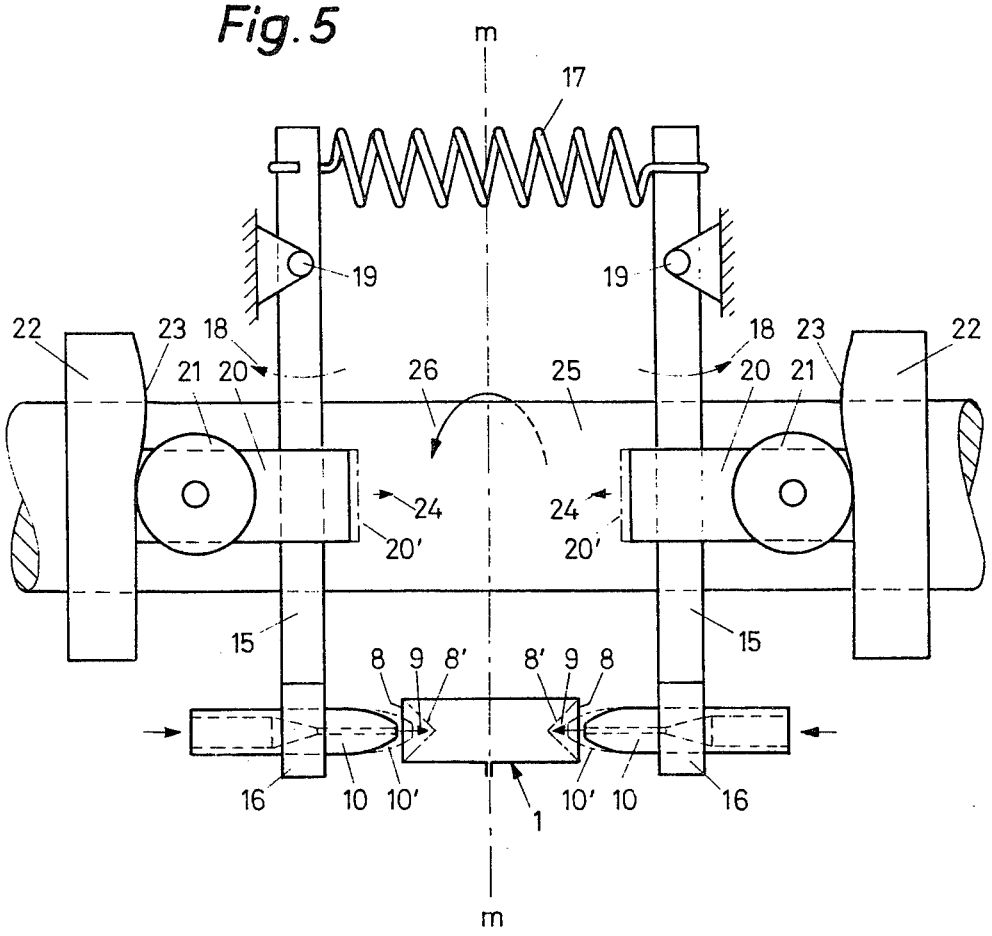
FIG. 5 is a schematic perspective view of the movement mechanism of the two nozzles of the apparatus of FIG. 1.

FIG. 5 does not show the means for producing the tube 1 which contains the items to be packaged or the sealing jaws provided for forming the transverse seams, or the blades serving to separate the packages. They are preferably designed as described with reference to FIGS. 1 to 4. FIG. 5 shows only that cross section of tube 1 where its oppositely disposed narrow sides 8 are exposed to the jets of pressurized air 9 directed toward them through the two nozzles 10.

In contradistinction to the embodiment according to FIGS. 1 through 4, the nozzles 10 are not attached to a housing or frame, but are fastened to the lower end of two levers 15. For this purpose, the ends of the levers are provided in the form of rings 16 through which nozzles 10 pass and in which they are held, for example, by screws. Levers 15 are arranged to be symmetrical to the vertical center plane m — m of the packaging tube 1, and of the entire apparatus, and are connected together at their upper ends by a tension spring 17. The spring thus tends to pivot the levers 15 about their pivot points 19 in the sense of arrows 18.

A respective supporting roller 21 is attached to each lever 15 by means of a mount 20 and is supported against a cam disc 22. Each cam disc 22 is provided with a cam surface 23 which comes to lie opposite the supporting roller 21 when the cam disc 22 rotates and thus pushes against its associated supporting roller 21, opposing the force of spring 17, in the direction of the respective arrow 24.

The two cam discs 22 are seated on a common shaft 25, which is rotated, for example, in the sense of arrow 26. The rotation of this shaft 25 is synchronized with the operation of the other parts in the apparatus so that cams 23 come to lie opposite their associated roller 21 during each operating cycle immediately before the moment at which the inward folding of the narrow sides 8 is to take place. The positions then taken by nozzles 10 and mounts 20 are shown at 10' and 20', respectively, in dot-dash lines. It can be seen that the tip of nozzle 10 in position 10' produces a small indentation in the narrow side 8. This indentation in the narrow side 8 of the tube produced by mechanical action of the nozzle forms the starting point for the fold in the narrow side. The jet of air from nozzle 10, which becomes effective at approximately the same time, then causes the actual folding process in which the narrow sides 8 are folded perfectly inwardly into the tube. Without this mechanical influence on the tube to initiate the folding action, the jet of air would not produce a clean fold but only an uncontrolled indentation in the tube.

It must be pointed out that the movement of nozzle 10 is very slight, substantially less than the movement of the purely mechanical gusset pleaters which cause the folding of the narrow sides without the pressurized air. Consequently it is possible to produce a very high output with the apparatus described in connection with FIG. 5, and the pivoting mechanism provided for the movement of nozzles 10 is extremely simple.

In principle, the inward movement of the nozzles to initiate the folding process could also be produced by other mechanisms without pivoting, but such mechanisms would probably have to be more complicated.

It should also be noted that the exit end of each nozzle 10 need not necessarily be conically tapered. It may be advisable to provide this end with a wedge-type taper, the edge of the wedge lying in the longitudinal direction of the narrow side 8, i.e. in the direction perpendicular to the plane of FIG. 5.

The pressurized air may be heated, if required, to a temperature of, e.g., 50° to 60°C in order to prevent the heat-sealable material from cooling too rapidly, as would be the case if the air were at room temperature. Instead of a rotational valve, other electrically or mechanically controlled pneumatic switching devices can also be used. However, with the relatively high number of revolutions of the sealing jaws, e.g. 600 rpm, at which the apparatus still operates very well, valves and the like are subject to relatively high wear in contradistinction to rotary slides.

It will be understood that the above description of the present invention is susceptible to various modifications, changes and adaptations, and the same are intended to be comprehended within the meaning and range of equivalents of the appended claims.

We claim:

1. Apparatus for forming gusset pleats in tubular packages on a continuously operating packaging machine in which items to be packaged are spaced at uniform intervals within a generally rectangular tube of sealable packaging material, and two oppositely disposed narrow sides of the tube are folded inwardly prior to a transverse seam being formed in the tube between every two items, said apparatus comprising: two nozzles positioned for directing two jets of a gaseous medium toward the oppositely disposed narrow sides of said tube for folding the narrow sidies inwardly; means connected to supply a gaseous medium under pressure to said nozzles; and means supporting said nozzles for movement in a manner to press said nozzles against the narrow sides of the packaging tube during each operating cycle so that said nozzles mechanically produce indentations therein which initiate the forming of the folds by the jets of gaseous medium.

2. Apparatus as defined in claim 1 wherein said nozzles are disposed symmetrically with respect to the tube axis and are centered in the longitudinal plane passing through the centers of the narrow sides of said tube, said nozzles being oriented with their axis forming an angle of 75° to 90° with the longitudinal direction of the tube.

3. Apparatus as defined in claim 2 wherein said angle is about 80°.

4. Apparatus as defined in claim 1 wherein said means supply the gaseous medium to said nozzles at periodic intervals, at least approximately during the time in which such transverse seam is being formed.

5. Apparatus as defined in claim 4 wherein the machine is provided with two sealing jaws and a mechanism for bringing the jaws periodically into contact with respectively opposite sides of the tube to form the transverse seams, and said means are arranged to supply the gaseous medium at approximately the times when the jaws contact the tube.

6. Apparatus as defined in claim 4 wherein said means comprises a rotational slide disposed for controlling the delivery of gaseous medium to said nozzles.

7. Apparatus as defined in claim 6 wherein said means further comprise a unit for heating the gaseous medium.

8. Apparatus as defined in claim 1 wherein said support means comprise a pair of pivotally mounted levers each carrying a respective nozzle, and a pair of cam discs each mounted for pivoting a respective one of said levers.

9. Apparatus as defined in claim 8 wherein said levers are mounted symmetrically to the center plane of the apparatus and said support means further comprise a pair of supporting rollers each mounted on a respective lever and bearing against a respective cam disc; a common shaft on which said cam discs are fastened; and spring means pressing said supporting rollers against said cam discs.

10. Apparatus as defined in claim 1 wherein said nozzles are provided with a wedge shaped taper at their outlet ends, the edge of the wedge extending in the longitudinal direction of said tube.

* * * * *